United States Patent [19]

Ito

[11] 4,392,811

[45] Jul. 12, 1983

[54] GASIFYING DEVICE FOR LIQUID FUEL BURNER

[75] Inventor: Takao Ito, Sanjo, Japan

[73] Assignee: Dainichi Kogyo Co., Ltd., Shirone, Japan

[21] Appl. No.: 234,432

[22] Filed: Feb. 13, 1981

[30] Foreign Application Priority Data

Feb. 16, 1980 [JP] Japan ..... 55-018867

[51] Int. Cl.[3] ..... F23N 1/00; F23D 11/44

[52] U.S. Cl. ..... 431/37; 431/208

[58] Field of Search ..... 431/208, 37

[56] References Cited

U.S. PATENT DOCUMENTS

| | | | |
|---|---|---|---|
| 2,785,741 | 3/1957 | Gravers | 431/37 X |
| 3,576,382 | 4/1971 | Finnstrand | 431/208 |
| 4,106,891 | 8/1978 | Schladitz | 431/208 X |

FOREIGN PATENT DOCUMENTS

| | | |
|---|---|---|
| 49-8176 | 9/1974 | Japan . |
| 52-50039 | 2/1977 | Japan . |
| 55-54719 | 5/1980 | Japan . |

*Primary Examiner*—William E. Wayner

*Attorney, Agent, or Firm*—Joseph R. Slotnik

[57] ABSTRACT

A gasified liquid fuel combustion apparatus for supplying a gaseous mixture of air and a gasified liquid fuel to a burner for combustion. The apparatus includes a gasifying device which comprises two spaced concentric tubes having a concentric inner tube therein. An electric heater is positioned in the space between the inner tube and the two concentric tubes and heats a chamber between the concentric tubes. Fuel is admitted to the lower rear end of the chamber and is gasified and then exits the gasifier through a nozzle connected to the forward end of the chamber. A solenoid controlled valve is operable to open and close the nozzle.

8 Claims, 5 Drawing Figures

GASIFYING DEVICE FOR LIQUID FUEL BURNER

SUMMARY OF THE INVENTION

The present invention relates to an improved gasifying device for an electric heated, gasified liquid fuel combustion apparatus which shortens the pre-heating time required for gasification of the liquid fuel thereby reducing the electric heating cost. In addition, the gasifying device of this invention achieves smooth flow of liquid fuel therethrough thereby preventing unstable pulsating combustion often encountered in conventional burners.

DETAILED DESCRIPTION

Figure 1:
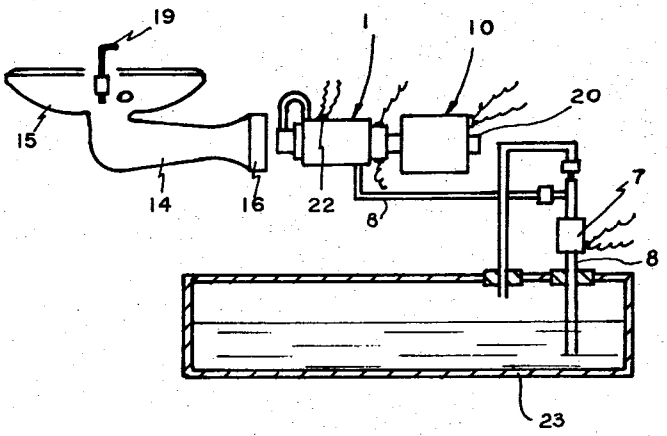
FIG. 1 is a view of a liquid fuel combustion apparatus which includes a gasifying device constructed according to the present invention.
Figure 2:
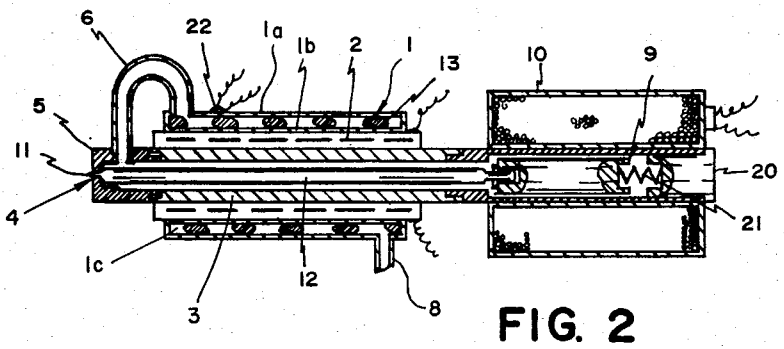
FIGS. 2 and 3 are enlarged cross-sectional views of the gasifying device in FIG. 1 and showing the exit nozzle in closed and opened positions, respectively.
Figure 3:
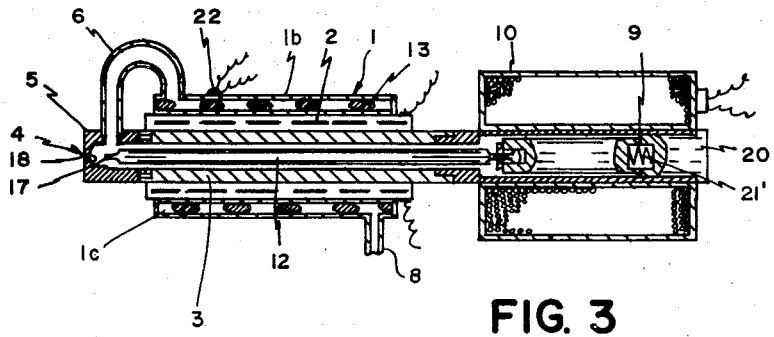

Referring to FIGS. 1, 2 and 3, a gasified liquid fuel combustion apparatus constructed according to the present invention comprises a gasifier 1 which includes a pair of concentric tubes 1*a*, 1*b* sealed at both ends and forming a chamber 1*c*. A tubular electric heater 2 is fitted inside tube 1*b* and an inner tube 3 is fitted inside electric heater 2 and is provided at its forward end with a nozzle head 5 formed with a nozzle 4.

As embodied herein, a fuel gas pipe 6 communicates an upper forward end of chamber 1*c* with the nozzle 4 while a fuel delivery pipe 8 communicates a fuel pump 7 with a lower rear end of the chamber 1*c*. A packing 13 which is constructed of heat-conductive material, for example, metal wires or metal ribbon, is arranged as a helix in the chamber 1*c*.

As further embodied herein, a solenoid 10 is mounted on the rear end of the inner tube 3 and has a movable core 9 disposed internally thereof. A fixed core 20 is secured inside solenoid 10. A compression spring 21 is positioned between fixed core 20 and movable core 9 and normally biases the latter in a left-hand direction as seen in FIGS. 2 and 3. A thermister 22 is provided on the gasifier 1 for temperature control as hereinafter described.

A valve rod 12 slidable inside the inner tube 3 is provided at its forward end with a valve member 17 which is engageable with a valve seat 18 around the nozzle 4. Valve member 17 is also formed with a valve needle 11 which can extend through and engage the nozzle 4 in the position of the parts shown in FIG. 2. The rear end of valve rod 12 is connected to the movable core 9 to move therewith.

A mixing pipe 14 leading to a burner 15 is so positioned as to have an aperture 16 in facing relationship to the nozzle 4. An ignition plug 19 is provided on the burner 15 for igniting a mixture of gasified fuel and air.

In use, the gasifier 1 is heated by supplying electric current to the heater 2. When the interior of the gasifier 1 reaches an appropriate temperature, the thermister 22 activates the fuel pump 7 to supply the gasifier 1 with fuel from a reservoir 23. At the same time, the solenoid 10 is energized whereby the fixed core 20 attracts the movable core 9 against the force of spring 21. This causes the valve member 17 to move from the FIG. 2 position to the FIG. 3 position and retract from the valve seat 18 and the valve needle 11 to retract from the nozzle 4 so that the nozzle 4 is now open. The fuel introduced into the gasifier 1 through the fuel delivery pipe 8 is gradually heated during its passage along the helical packing 13 and, after complete gasification, is supplied to the nozzle head 5 through the fuel gas pipe 6.

The inner tube 3 is maintained at a high temperature by the surrounding heater 2 and this causes the nozzle head 5 to be heated by conduction. Therefore, the gasified fuel oil is ejected from the nozzle 4 without cooling and enters the aperture 16 of the mixing pipe 14. The gasified fuel is burnt at the burner 15 after mixing with primary air drawn inwardly simultaneously with passage of the fuel to the burner 15.

It will be appreciated that fuel is introduced from the fuel pump 7 through fuel delivery pipe 8 into the gasifier 1 through an aperture at the lower rear end thereof. Also, only gasified fuel flows out through the fuel gas pipe 6 which is provided at the upper front end of the gasifier 1. Any ungasified fuel will remain in the lower part of the gasifier 1. The fuel is therefore gradually elevated in the gasifier as it is gasified without turbulence in its flow thereby ensuring continuous ejection of the gasified fuel from the nozzle 4 and preventing pulsating combustion.

A prolonged sojourn of the fuel at the gasifying temperature leads to tar formation, giving eventual rise to hindered flow in the fuel gas pipe or hindered gas emission by nozzle clogging. This is prevented in the present invention because gasification of the fuel introduced into the gasifier 1 takes place in a continuous manner.

Also the gasifier 1 of the present invention provides efficient heating of the fuel because of the high surface-to-volume ratio achieved by the concentric double tubular structure 1*a*, 1*b*, and also because the heater 2 is in contact with the inner wall 1*b* of the gasifier 1.

In the apparatus of the present invention, combustion at the burner 5 can be terminated immediately simply by interrupting the electric power supply. This deenergizes the solenoid 10 whereby the valve rod 12 is displaced toward the left under the bias of the spring 21 to bring the valve member 17 into contact with the valve seat 18, thereby closing the nozzle 4 and terminating fuel ejection. At the same time, the valve needle 11 enters the nozzle 4 to remove soot or foreign matter which may have accumulated in the nozzle 4.

Figure 4:
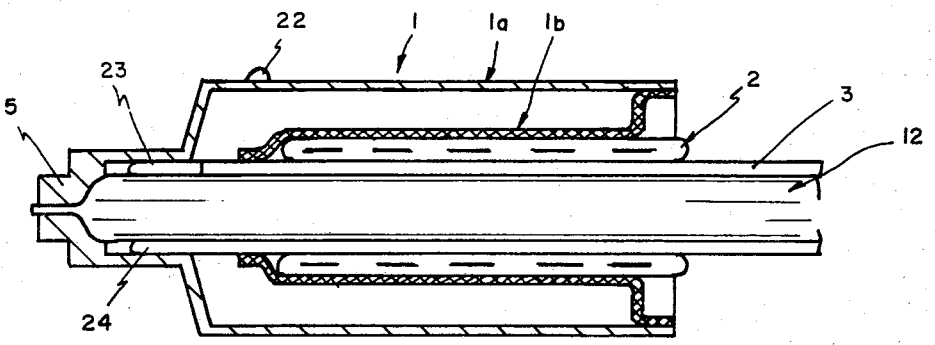
FIG. 4 is a cross-sectional view of modified form of gasifying device according to this invention.
Figure 5:
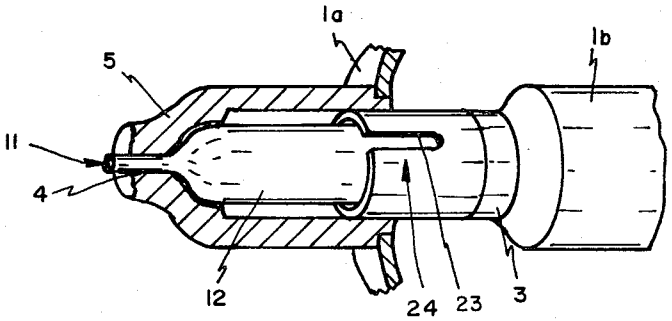
FIG. 5 is an enlarged perspective view of a portion of FIG. 4.

FIGS. 4 and 5 show another embodiment of the present invention. In this embodiment, the outer wall 1*a* and inner wall 1*b* of the gasifier 1 are sealed only at the rear end thereof. At the front end of the gasifier 1, the outer wall 1*a* is fixed to the nozzle head 5 while the inner head 1*b* is fixed to the inner tube 3.

As shown in FIG. 5, there is a collar 24 formed with a notch 25 and disposed at the forward end of inner tube 3. The collar 24 is slidably disposed within the nozzle head 5 and slidably receives the valve rod 12. A clearance is provided between the forward end of the collar 24 and that of the nozzle head 5. In this embodiment, gasified fuel is introduced from the gasifier 1 into the nozzle head 5 through the notch 25. When the valve rod 12 is positioned toward the right from the position shown in FIGS. 4 and 5, gasified fuel is emitted from the nozzle 4.

Any difference in thermal expansion between the outer wall 1*a* and the inner wall 1*b* caused by a temperature difference in the initial period of heating by the heater 2 is accomodated by the sliding fit of the collar 24 in the nozzle head 5 so that deformation or destruction of the gasifier 1 is prevented.

What is claimed is:

1. A gasified liquid fuel combustion apparatus for supplying a gaseous mixture of air and a gasified liquid fuel ejected from a nozzle to a burner for combustion, said apparatus including a gasifying device comprising:

(a) a gasifier including two concentric tubes having front and rear ends and defining a chamber and sealed at least at the rear end thereof and having a concentric inner tube disposed therein, said gasifier and inner tube being in sealed communicating relation with a nozzle head provided concentrically with and at the front end of said inner tube, said nozzle head including a nozzle;

(b) a valve rod provided in said inner tube and having at its front end a valve needle cooperable with said nozzle;

(c) a movable core provided at the rear end of said valve rod;

(d) a solenoid provided at the rear end of said inner tube and operable to move said movable core;

(e) an electric heater provided in a concentric space between said gasifyer and said inner tube;

(f) a fuel delivery pipe connected to the lower rear end of said gasifier and adapted to deliver fuel to the rear end of said gasifier chamber;

(g) means causing said fuel to travel in a helical path around and along said chamber from its rear end to its front end; and (h) means connecting the front end of said gasifier chamber to said nozzle.

2. An apparatus according to claim 1, wherein said movable core is disposed inside said inner tube, and said solenoid is disposed on the outside of the rear end of said inner tube.

3. An apparatus according to claim 2, wherein said inner tube is provided at the rear end thereof with a fixed core, and a compression spring is provided between said movable core and said fixed core.

4. An apparatus according to claim 1, wherein said means causing said fuel to travel in a helical path includes heat-conductive packing provided in said gasifier chamber formed between said concentric tubes of said gasifier.

5. An apparatus according to claim 4, wherein said heat-conductive packing is formed from metal wires or metal ribbons.

6. An apparatus according to claim 4, wherein said heat-conductive filler is arranged in a helix in said chamber.

7. An apparatus according to claim 1, wherein said connecting means connects the upper forward end of said chamber to said nozzle head for delivering gasified fuel to said nozzle.

8. An apparatus according to claim 1, wherein said gasifier includes temperature responsive means controlling delivery of fuel to said fuel delivery pipe in response to the temperature in said chamber.

* * * * *